US005372009A

United States Patent [19]

Kaufman et al.

[11] Patent Number: 5,372,009

[45] Date of Patent: Dec. 13, 1994

[54] CRYOGENIC DISTILLATION

[75] Inventors: Eric A. Kaufman, Beaumont; Jack A. Moss; John L. Pickering, Jr., both of Kingwood, all of Tex.

[73] Assignee: Mobil Oil Corporation, Fairfax, Va.

[21] Appl. No.: 149,495

[22] Filed: Nov. 9, 1993

[51] Int. Cl.[5] ..... F25J 3/02

[52] U.S. Cl. ..... 62/24; 62/28; 62/39

[58] Field of Search ..... 62/24, 28, 39

[56] References Cited

U.S. PATENT DOCUMENTS

| | | | |
|---|---|---|---|
| 3,126,267 | 7/1959 | Arend | 62/27 |
| 3,702,541 | 11/1972 | Randall et al. | 62/26 |
| 4,270,940 | 6/1981 | Rowles et al. | 62/28 |
| 4,368,061 | 1/1983 | Mestrallet et al. | 62/28 |
| 4,460,396 | 1/1984 | Kaiser et al. | 62/28 |
| 4,496,380 | 1/1985 | Harryman | 62/24 |
| 4,501,600 | 2/1985 | Pahade | 62/28 |
| 4,548,629 | 10/1985 | Chtu | 62/24 |
| 4,900,347 | 2/1990 | McCue, Jr. et al. | 62/24 |

*Primary Examiner*—Ronald C. Capossela
*Attorney, Agent, or Firm*—Alexander J. McKillop; Malcolm D. Keen; L. Gene Wise

[57] ABSTRACT

A cryogenic technique for recovering pure products from a mixture of at least three close-boiling components. A preferred process is provided for separating a hydrocarbon mixture containing an alkene (i.e. ethene or propene), corresponding alkane having the same number of carbon atoms and at least one heavier hydrocarbon component. The improved process comprises: feeding the hydrocarbon mixture to a first distillation tower having an upper reflux stage; recovering a first overhead vapor stream rich in alkene and alkane from the first distillation tower and passing the first overhead vapor stream to a middle distillation stage of a second multi-stage distillation tower; recovering a second overhead vapor stream rich in alkene from the second distillation tower; adiabatically compressing the alkene-rich vapor stream and passing the compressed vapor to a second distillation tower reboiler stage. This provides a heat pump for cooling and condensing the compressed vapor and heating a liquid reboiler stream. Pressure in the alkene stream is reduced by flashing cooled and condensed vapor from the reboiler stage to provide a partially vaporized flashed mixture stream rich in alkene, followed by recovering and separating the flashed mixture stream to provide recovering a liquid portion and vapor portion. The liquid portion is passed to a second distillation tower reflux stage and a pure alkene stream is recovered.

5 Claims, 2 Drawing Sheets

CRYOGENIC DISTILLATION

BACKGROUND OF THE INVENTION

The present invention relates to improvement in fractionation of close boiling volatile components, especially cryogenic separation of light gases. In particular it relates to a new method for recovering ethene (ethylene) or propene (propylene) from cracking gas or the like in mixture with other components requiring low temperature refrigeration.

Cryogenic technology has been employed on a large scale for recovering gaseous hydrocarbon components, such as $C_1$–$C_2$ alkanes and alkenes from diverse sources, including natural gas, petroleum refining, coal and other fossil fuels. Separation of high purity ethene from other gaseous components of cracked hydrocarbon effluent streams has become a major source of chemical feedstocks for the plastics industry. Polymer grade ethene, usually containing less than 1% of other materials, can be obtained from numerous industrial process streams. Thermal cracking and hydrocracking of hydrocarbons are employed widely in the refining of petroleum and utilization of $C_2$+ condensible wet gas from natural gas or the like. Low cost hydrocarbons are typically cracked at high temperature to yield a slate of valuable products, such as pyrolysis gasoline, lower olefins and LPG, along with byproduct methane and hydrogen. Conventional separation techniques near ambient temperature and pressure can recover many cracking effluent components by sequential liquefaction, distillation, sorption, etc. However, separating methane and hydrogen from the more valuable $C_2$+ aliphatics, especially ethene, ethane, propene, and/or propane requires relatively expensive equipment and processing energy. Primary emphasis herein is placed on a typical large scale cryogenic plant for recovering ethene from cracking gas.

Typical cryogenic systems are described in U.S. Pat. Nos. 3,126,267 (VanderArend); 3,702,541 (Randall et al); 4,270,940 (Rowles et al); 4,460,396 (Kaiser et al); 4,496,380 (Harryman); 4,368,061 (Mostrail et al); and 4,900,347 (McCue et al).

It is an object of the present invention to provide an improved cold fractionation system for separating light gases at low temperature which is energy efficient and saves capital investment in cryogenic equipment.

SUMMARY OF THE INVENTION

A new cryogenic technique has been found for separating close boiling mixtures having at least three components. The process and apparatus are useful in recovering pure products from a feed gas comprising close-boiling components, such as ethene and ethane in mixture with $C_3$+ components.

A preferred embodiment provides for separating a hydrocarbon mixture containing ethene, ethane and at least one heavier hydrocarbon component comprising: feeding the hydrocarbon mixture to a de-ethanizer distillation tower having an upper reflux stage; recovering a first overhead vapor stream rich in ethene and ethane from the de-ethanizer tower and passing said first overhead vapor stream to a middle distillation stage of a second distillation tower; controlling operating pressure in the second distillation tower at predetermined pressure; recovering a second overhead vapor stream rich in ethene from the second distillation tower; adiabatically compressing the ethene-rich vapor stream and passing said compressed vapor to a second distillation tower reboiler stage; cooling and condensing the compressed vapor and heating a liquid reboiler stream; flashing cooled and condensed vapor from the reboiler stage to provide a partially vaporized flashed mixture stream rich in ethene; recovering and separating the flashed mixture stream to provide a liquid portion and vapor portion; passing the liquid portion to a second distillation tower reflux stage; withdrawing an intermediate liquid stream rich in ethene and ethane from a middle stage of the second distillation tower; and passing said intermediate liquid stream to a first distillation tower reflux stage; recovering the heavier component from the first distillation tower; and recovering ethane from the second distillation tower reboiler stage; recovering an ethene product stream. Advantageously (absolute) pressure is maintained in the first distillation unit not substantially higher than the second distillation unit pressure.

THE DRAWINGS

FIG. 1 is a schematic process flow diagram depicting arrangement of unit operations for a typical hydrocarbon processing plant utilizing cracking and cold fractionation for ethene production; and FIG. 2 is a detailed process and equipment diagram showing in detail an improved multi-tower distillation section for de-propanizing a cryogenic fraction and splitting a $C_3$ stream into propene and other product streams.

DESCRIPTION OF PREFERRED EMBODIMENTS

In the following description, metric units and parts by weight are used unless otherwise stated, and gaseous mixtures are sometimes given in moles or mol %. Temperature is given in degrees Celsius (°C.) or Kelvin (K).

Cryogenic Separation Feedstocks

The present process is useful for separating mainly $C_2$–$C_4$+ gaseous mixtures containing large amounts of ethene, ethane and/or propene/propane. Significant amounts of hydrogen and methane usually accompany cracked hydrocarbon gas, along with minor amounts of $C_3$+ hydrocarbons, nitrogen, carbon dioxide and acetylene. The acetylene component may be removed before cryogenic operations. Typical petroleum refinery off-gas or paraffin cracking effluent are usually pretreated to remove any acid gases and dried over a water-absorbing molecular sieve to a dew point of about 145° K to prepare the cryogenic feedstock mixture. A typical feedstock gas comprises cracking gas containing about 10 to 50 mole percent ethene, 5 to 20% ethane, 10 to 40% methane, 10 to 40% hydrogen, and up to 10% $C_3$ hydrocarbons. This feedstock is demethanized and may be depropanized and/or de-ethanized to concentrate the desired components in a feedstream suitable for use in the improved process described herein.

In a preferred embodiment, dry compressed cracked feedstock gas at ambient temperature or below and at process pressure of at least 2500 kPa (350 psig), preferably about 3700 Kpa (37.1 kgf/cm$^2$, 520 psig), is separated in a chilling train under cryogenic conditions into several liquid streams and gaseous methane/hydrogen streams. The more valuable ethene stream is recovered at high purity suitable for use in conventional polymerization.

Process Description

Figure 1:
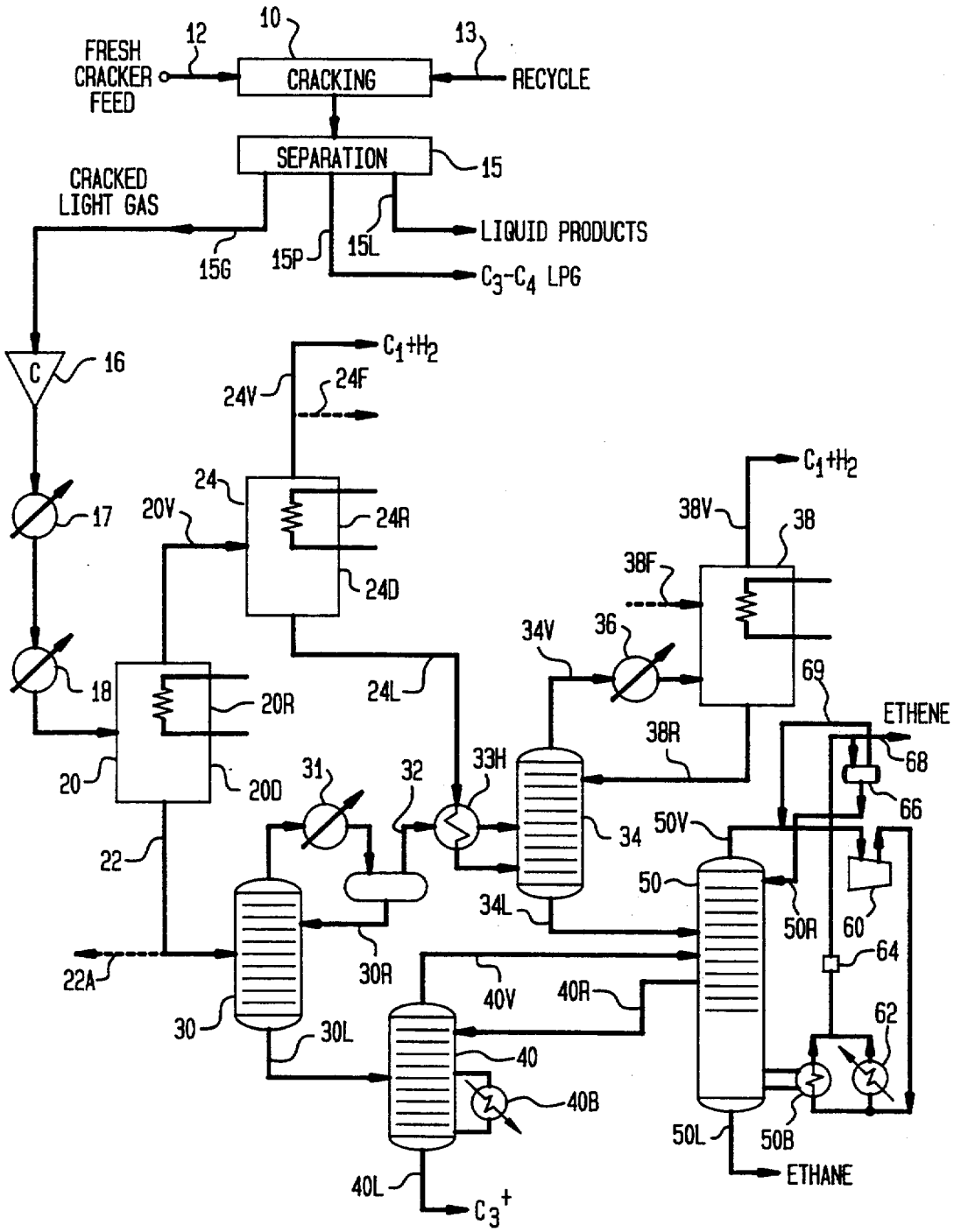

Referring to FIG. 1, a cryogenic separation system for recovering purified ethene from hydrocarbon feedstock gas is depicted in a schematic diagram. A conventional hydrocarbon cracking unit 10 converts fresh feed, such as ethane, propane, naphtha or heavier feeds 12 and optional recycled hydrocarbons 13 to provide a cracked hydrocarbon effluent stream. The cracking unit effluent is separated by conventional techniques in separation unit 15 to provide liquid products 15L, $C_3$–$C_4$ petroleum gases 15P and a cracked light gas stream 15G, consisting mainly of methane, ethene and ethane, with varying amounts of hydrogen, acetylene and $C_3$+ components. The cracked light gas is brought to process pressure by compressor means 16 and cooled below ambient temperature by heat exchange means 17, 18 to provide feedstock for the cryogenic separation, as herein described.

In the chilling train cold pressurized gaseous streams are cooled and partially condensed in serially arranged rectification units, each of said rectification units being operatively connected to accumulate condensed liquid in a lower liquid accumulator portion by gravity flow from an upper vertical rectifier portion through which gas from the lower accumulator portion passes in an upward direction for direct gas-liquid contact exchange within said rectifier portion, whereby methane-rich gas flowing upwardly is partially condensed in said rectifier portion with cold refluxed liquid in direct contact with the upward flowing gas stream to provide a condensed stream of cold liquid flowing downwardly and thereby enriching condensed liquid gradually with ethene and ethane components. Preferably, at least one of the rectification units comprises a dephlegmator-type rectifier unit; however, a packed column or tray contact unit may be substituted in the chilling train. Dephlegmator heat exchange units are typically aluminum core structures having internal vertical conduits formed by shaping and brazing the metal, using known construction methods.

The cold pressurized gaseous feedstock stream is separated in a plurality of sequentially arranged dephlegmator-type rectification units 20, 24. Each of these rectification units is operatively connected to accumulate condensed liquid in a lower drum portion 20D, 24D by gravity flow from an upper rectifier heat exchange portion 20R, 24R comprising a plurality of vertically disposed indirect heat exchange passages through which gas from the lower drum portion passes in an upward direction for cooling with lower temperature refrigerant fluid or other chilling medium by indirect heat exchange within the heat exchange passages. Methane-rich gas flowing upwardly is partially condensed on vertical surfaces of the heat exchange passages to form a reflux liquid in direct contact with the upward flowing gas stream to provide a condensed stream of cooler liquid flowing downwardly and thereby enriching condensed liquid gradually with ethene and ethane components.

The preferred system provides means for introducing dry feed gas into a primary rectification zone or chilling train having a plurality of serially connected, sequentially colder rectification units for separation of feed gas into a primary methane-rich gas stream 20V recovered at low temperature and at least one primary liquid condensate stream 22 rich in $C_2$ hydrocarbon components and containing a minor amount of methane.

The condensed liquid 22 is purified to remove methane by passing at least one primary liquid condensate stream from the primary rectification zone to a fractionation system having serially connected demethanizer zones 30, 34. A moderately low cryogenic temperature is employed in heat exchanger 31 to refrigerate overhead from the first demethanizer fractionation zone 30 to recover a major amount of methane from the primary liquid condensate stream in a first demethanizer overhead vapor stream 32 and to recover a first liquid demethanized bottoms stream 30L rich in ethane and ethene and substantially free of methane. Advantageously, the first demethanizer overhead vapor stream is cooled with moderately low temperature refrigerant, such as available from a propylene refrigerant loop, to provide liquid reflux 30R for recycle to a top portion of the first demethanizer zone 30.

An ethene-rich stream is obtained by further separating at least a portion of the first demethanizer overhead vapor stream in an ultra-low temperature final demethanizer zone 34 to recover a liquid first ethene-rich hydrocarbon crude product stream 34L and a final demethanizer ultra-low temperature overhead vapor stream 34V. Any remaining ethene is recovered by passing the final demethanizer overhead vapor stream 34V through ultra low temperature heat exchanger 36 to a final rectification unit 38 to obtain a final ultra-low temperature liquid reflux stream 38R for recycle to a top portion of the final demethanizer fractionator. A methane-rich final rectification overhead vapor stream 38V is recovered substantially free of $C_2$+ hydrocarbons. Utilizing the dual demethanizer technique, a major amount of total demethanization heat exchange duty is provided by moderately low temperature refrigerant in unit 31 and overall energy requirements for refrigeration utilized in separating $C_2$+ hydrocarbons from methane and lighter components are decreased. The desired purity of ethene product is achieved by further fractionating the $C_2$+ liquid bottoms stream 30L from the first demethanizer zone in a de-ethanizer fractionation tower 40 to remove $C_3$ and heavier hydrocarbons in a $C_3$+ stream 40L and provide a second crude ethene stream 40V, which is recovered as a vapor without substantial condensation or direct reflux according to the improved operating technique.

The present invention achieves improved operating economy and lower capital equipment requirements by passing overhead vapor stream 40V to a middle stage of distillation tower unit 50, commonly known as a $C_2$ product splitter. Ethene-rich vapor is recovered from tower 50 via overhead 50V. Optionally, the polymer grade product is obtained by cofractionating the second crude ethene stream 40V and the first ethene-rich hydrocarbon crude product stream 34L to obtain a purified ethene product. The ethane bottoms stream 50L can be optionally recycled to cracking unit 10, with recovery of thermal values by indirect heat exchange with moderately chilled feedstock in exchangers 17, 18 and/or 20R. $C_3$+ stream 40L may be sent to downstream fractionation facilities for recovery of other valuable components such as propene, butenes, etc.

Overhead vapor stream 50V is advantageously compressed adiabatically in compressor unit 60 to recover energy as a heat pump to reboiler 50B, after which it is combined with an optional bypass stream from trim cooler 62 and depressurized by flashing means 64, partially condensing the ethene-rich stream. Phase separator vessel 66 recovers a liquid reflux stream 50R and ethene product stream 68 is withdrawn. Uncondensed vapor stream 69 may be combined with tower overhead stream 50V for recompression.

A major advantage of this invention is realized by withdrawing a liquid $C_2$ stream 40R from tower 50 adjacent the inlet of stream 40V and passing liquid 40R to an upper stage of tower 40 as reflux. The effective reflux ratio is maintained at about 1:5 to 1:10, preferably controlled at 0.15 (wt. of liquid reflux/wt. of total overhead vapor). This feature of the invention will be seen in the comparison of operating the present system with that of prior art distillation.

One of the major operating advantages for $C_2$ cryogenic recovery systems is the enhanced separation of ethane and ethene that can be achieved in the same distillation column at lower pressure. The combination of the "umbilical" reflux arrangement between two adjacent towers permits greater savings in utility costs for this technique. Operation of the Advanced Recovery System cryogenic separation plant depicted in FIG. 1 is described in detail in U.S. Pat. No. 4,900,347 (McCue and Pickering), incorporated herein by reference.

Figure 2:
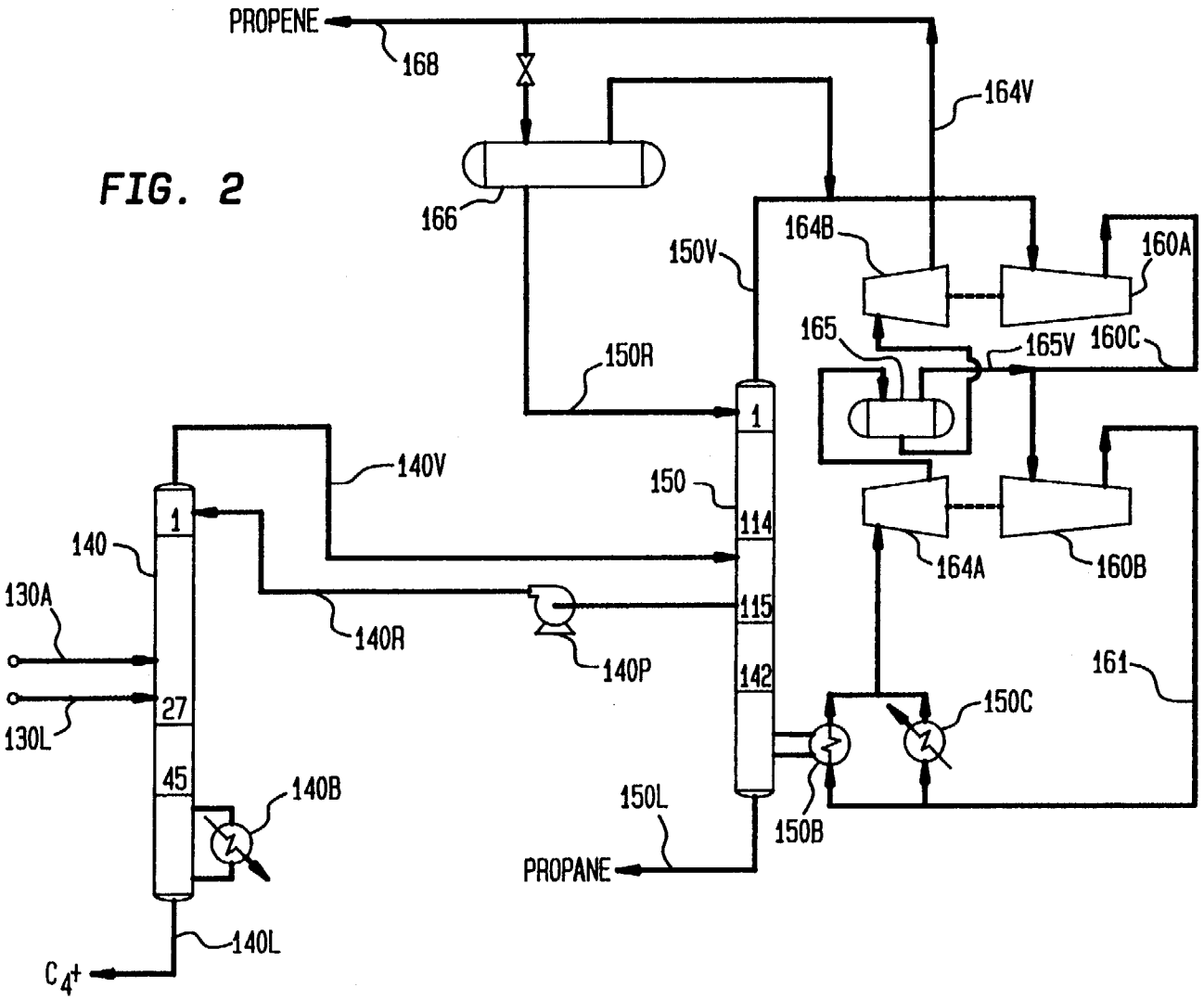

An improved alkene recovery fractionation system is shown in FIG. 2, wherein ordinal numbers correspond with their counterpart equipment in FIG. 1. A continuous distillation system is provided for separating mixtures of at least three volatile components each having different normal boiling points. This feedstock is exemplified by a propene-rich feedstream 130L, which feed has been de-ethanized to remove $C_2$-components and heavy cracking liquids to provide gaseous or liquid feedstock containing propene, propane and $C_4$+ components, such as butenes, butanes, etc. Multiple liquid or gas feedstreams may be employed, for instance, additional stream 130A. As depicted in FIG. 2, there are first and second distillation towers 140, 150, each having an upper reflux stage (-1-), middle distillation stages and a lower reboiler stage, with the second distillation tower 150 being operatively connected to receive a first overhead vapor stream 140V from the first distillation tower 140 at a middle stage (eg -115-). The system includes conventional means for controlling operating pressure in the second distillation tower at predetermined pressure, as in a typical cryogenic fluid handling system by compressor, pump and valve control means.

Compression with single stage is ordinarily sufficient. As depicted, multi-stage compression means 160A, 160B are operatively connected to receive a second overhead vapor stream 150V rich in at least one low boiling component (e.g. propene) from the second distillation tower upper reflux stage for adiabatic compression. Conduit means 161 is provided for passing adiabatically compressed vapor from the last stage compressor 160B to the second distillation tower reboiler stage 150B for condensing the compressed vapor and heating the liquid reboiler stream.

Flashing means is provided for decreasing pressure on the condensed vapor to provide a partially vaporized flashed mixture stream rich in low boiling component. This can be achieved in a single flashing unit; however, it is advantageous to achieve pressure reduction in a single flashing step or a series of expansion turbines 164A, 164B operatively connected for fluid flow and mechanically linked to corresponding compressors to recover energy from the flashing expansion during the depressurizing steps. Intermediate separator unit 165 provides an intermediate vapor stream 165V for mixing with first stage compressed vapor stream 160C as feed to the second stage compressor 160B.

Reflux fluid handling means is provided by separator unit 166 operatively connected for receiving the flashed mixture stream 164V, recovering a liquid portion 150R and vapor portion 168 rich in propene, and passing the liquid portion 150R to the second distillation tower 150 reflux stage. Pump means 140P is operatively connected by conduits for withdrawing an intermediate liquid stream 140R rich in low boiling and medium boiling components (e.g. propene and propane) from a middle stage of the second distillation tower 150 and passing the intermediate liquid stream to the first distillation tower 140 reflux stage. The desired reflux ratio (i.e. less than 0.5) may be controlled by convertional fluid handling means, pump 140p, valve means, ratio controller, etc.

Bottom conduit means 140L recovers at least one high boiling component (e.g. $C_4$+) from the first distillation tower reboiler stage, conduit means 150L recovers at least one middle boiling component (e.g. propane) from the second distillation tower reboiler stage; and conduit means 168 recovers the low boiling component (e.g. propene).

In order to obtain full benefit from the "umbilical" configuration wherein reflux heat load for the primary distillation unit is provided by the rectification in the second distillation unit, it is desirable to provide conventional fluid control means for maintaining operating pressure in the first distillation unit not substantially greater than the second distillation operating pressure, usually less that 10–20% greater than the absolute second pressure. In the separation of propene from heavier hydrocarbons, lower pressure operation of the depropanizer tower permits a lower temperature operation in the reboiler stage thereof, thus avoiding undesirable reactions in this zone, especially polymerization of unsaturated $C_4$'s, such as butenes and diene.

EXAMPLE

A material balance with energy requirements is given for the production of polymer grade ethene according to the present invention and compared with conventional cryogenic distillation. In the following table, all units are based on steady state continuous stream conditions and the relative amounts of the components in each stream are based on 100 parts by weight of the feedstream. The utility requirements of de-ethanizer and $C_2$ splitter tower operations are given.

| | STREAM COMPOSITION PER 100 kG OF STREAM RATE (Kg per 100 Kg) | | | | | | |
|---|---|---|---|---|---|---|---|
| Stream No. (FIG. 1) | 30L | 40V | 40R | 40L | 50L | 68 | 50R |
| Ethylene | 66.61 | 71.61 | 59.49 | 0.00 | 0.08 | 99.89 | 99.89 |
| Ethane | 23.57 | 28.19 | 40.48 | 0.25 | 99.04 | 0.11 | 0.11 |
| Propodiene | 0.80 | 0.00 | 0.00 | 8.35 | 0.00 | 0.00 | 0.00 |
| Propylene | 7.36 | 0.20 | 0.03 | 74.24 | 0.87 | 0.00 | 0.00 |
| Propane | 1.66 | 0.00 | 0.00 | 17.16 | 0.01 | 0.00 | 0.00 |

-continued

| 100.00 Kg | 100.0 Kg | 100.00 Kg | 100.00 Kg | 100.00 Kg | 100.00 Kg | 100.00 Kg |
|---|---|---|---|---|---|---|
| STREAM ENTHALPIES PER 100 Kg OF STREAM RATE (KJ per 100 Kg) | | | | | | |
| 30L | 40V | 40R | 40L | 50V | 68 | 50R |
| −7,098 | +23,241 | −17,138 | +3,620 | −11,735 | +30,135 | −20,378 |

| | |
|---|---|
| Deethanizer Tower | |
| Overhead Pressure, kPa | 859.75 |
| Overhead Temp, °K. | 222.7 |
| Bottoms, Temp, °K. | 289.8 |
| Reflux Ratio, Kg reflux/Kg overhead vapor | 0.15 |
| $C_2$ Splitter Tower | |
| Overhead Pressure, kPa | 790.80 |
| Overhead Temp, °K. | 214.4 |
| Bottoms Temp, °K. | 235.6 |
| Reflux Ratio, Kg reflux/Kg overhead vapor | 0.70 |
| Process Duties per 100 Kg of System Feed (KJ per 100 Kg) | |
| Deethanizer Reboiler | 34,766 |
| Deethanizer Condenser (omitted) | None |
| $C_2$ Splitter Reboiler | 48,142 |
| $C_2$ Splitter Trim Cooler | 35,504 |
| $C_2$ Splitter Heat Pump | 25,443 |

It will be appreciated by one skilled in cryogenic engineering that the arrangement of unit operations allows reduction of reflux cooling requirements in the de-ethanizer zone as compared to conventional reflux type distillation units.

The low pressure, combined deethanizer/$C_2$ splitter system requires 20% less process refrigeration than a conventional, high pressure separate dethanizer/$C_2$ splitter system. In addition, the capital equipment cost for the combined deethanizer/$C_2$ splitter system is less than a conventional system. The advantages of the combined low pressure deethanizer/$C_2$ splitter can be classified into two areas: the advantages of low pressure deethanization, and the advantages of using the $C_2$ splitter to reflux the deethanizer.

Operating the deethanizer at the lower overhead pressure (859.75 KPA vs 2983.33 KPA) facilitates the separation of ethane and propylene. The improved fractionation performance results from the inverse proportionality between the relative volatility of ethane to propylene and distillation pressure. The improved performance is manifested in a lower requirement for reflux in the above low pressure deethanizer tower. The performance reflux ratio for the low pressure deethanizer is maintained below 0.2 of an ethene recovery unit, preferably 0.15, while the required ratio for a conventional high pressure deethanizer is 0.38.

The reduced reflux requirement of the low pressure deethanizer results in two direct benefits: 1) a reduction in the process refrigeration required to condense the deethanizer overhead vapor. Since less reflux is required, less vapor needs to be condensed. This results in a direct utility savings in the operation of refrigeration system compressors; 2) a reduction in reflux pumping costs due to lower reflux volumes.

An additional benefit of the low pressure deethanizer is the ability to reboil the tower with condensing propylene refrigerant. The low pressure deethanizer requires a lower reboiler temperature than the high pressure deethanizer (289.8° K vs. 344.4° K). The lower reboiler temperature of the low pressure deethanizer is approximately the condensing temperature (dew point temperature) of high pressure propylene refrigerant. Therefore, the low pressure deethanizer reboiler could be used to condense refrigerant, providing an energy credit to the refrigeration system.

Use of a liquid draw from the $C_2$ splitter to provide reflux for the deethanizer results in a less expensive design than a conventional separate deethanizer/$C_2$ splitter system. Both the combined and separate systems require the same distillation towers, towers reboilers, and $C_2$ splitter heat pump equipment. In addition, the conventional deethanizer/$C_2$ splitter system requires a deethanizer overhead condenser and a deethanizer reflux drum. The combined system, however, does not require a deethanizer overhead condenser or deethanizer reflux drum. As a result, the total equipment cost for the combined system is lower than a conventional system.

The liquid draw from the $C_2$ splitter tower does not significantly affect the operation of the $C_2$ splitter. The liquid rate in the $C_2$ splitter tower is an order of magnitude higher than the liquid draw used for deethanizer reflux. The power requirement for the $C_2$ splitter heat pump increase by less than 3% when the deethanizer reflux stream is withdrawn from the $C_2$ splitter tower.

The increase in $C_2$ splitter trim cooler duty is more than offset by the elimination of the deethanizer condenser. The two units requiring process refrigeration in the deethanizer/$C_2$ splitter system are the deethanizer condenser and the $C_2$ splitter trim cooler. The combined, low pressure deethanizer/$C_2$ splitter system provides a 20% net reduction in overall refrigeration requirements over a conventional system.

While the invention has been described by specific examples, there is no intent to limit the inventive concept except as set forth in the following claims.

We claim:

1. A continuous distillation system for separating mixtures containing mixtures of at least three volatile components each having different normal boiling points; comprising:

first and second distillation towers, each having an upper reflux stage, middle distillation stages and a lower reboiler stage; the second distillation tower being operatively connected to receive a first overhead vapor stream from the first distillation tower;

means for controlling operating pressure in the second distillation tower at predetermined pressure;

compression means operatively connected to receive a second overhead vapor stream rich in at least one low boiling component from the second distillation tower reflux stage for adiabatic compression;

means for passing adiabatically compressed vapor from the compressor means to the second distillation tower reboiler stage for condensing the compressed vapor and heating a liquid reboiler stream;

flashing means for decreasing pressure on the condensed vapor to provide a partially vaporized flashed mixture stream rich in low boiling component;

reflux fluid handling means operatively connected for receiving the flashed mixture stream, recovering a liquid portion and vapor portion thereof, and passing the liquid portion to the second distillation tower reflux stage;

means for withdrawing an intermediate liquid stream rich in low boiling and medium boiling components from a middle stage of the second distillation tower and passing said intermediate liquid stream to the first distillation tower reflux stage;

means for recovering at least one high boiling component from the first distillation tower reboiler stage;

means for recovering at least one middle boiling component from the second distillation tower reboiler stage;

means for recovering the low boiling component; and means for maintaining operating pressure in the first distillation tower not substantially greater than the second distillation tower operating pressure.

2. The distillation system of claim 1 including means for said intermediate liquid stream to said first distillate to a reflux stage at a reflux ratio not greater than 0.5.

3. A process for separating a hydrocarbon mixture containing ethene, ethane and at least one heavier hydrocarbon component comprising the steps of:

feeding said hydrocarbon mixture to a de-ethanizer distillation tower having an upper reflux stage;

recovering a first overhead vapor stream rich in ethene and ethane from the de-ethanizer tower and passing said first overhead vapor stream to a middle distillation stage of a second distillation tower;

controlling operating pressure in the second distillation tower at predetermined pressure;

recovering a second overhead vapor stream rich in ethene from the second distillation tower;

adiabatically compressing the ethene-rich vapor stream and passing said compressed vapor to a second distillation tower reboiler stage;

cooling and condensing the compressed vapor and heating a liquid reboiler stream;

flashing cooled and condensed vapor from the reboiler stage to provide a partially vaporized flashed mixture stream rich in ethene;

recovering and separating the flashed mixture stream to provide recovering a liquid portion and vapor portion;

passing the liquid portion to a second distillation tower reflux stage;

withdrawing an intermediate liquid stream rich in ethene and ethane from a middle stage of the second distillation tower and passing said intermediate liquid stream to a first distillation tower reflux stage;

recovering the heavier component from the first distillation tower;

recovering ethane from the second distillation tower reboiler stage;

recovering an ethene product stream; and maintaining absolute pressure in the first distillation tower not more than 10% higher than the second distillation tower absolute pressure.

4. The process of claim 3 wherein the intermediate liquid stream is introduced to the top of the first distillation tower at a reflux ratio not greater than 0.15.

5. A process for separating a hydrocarbon mixture containing an alkene, corresponding alkane having the same number of carbon atoms and at least one heavier hydrocarbon component comprising the steps of:

feeding said hydrocarbon mixture to a first distillation tower having an upper reflux stage;

recovering a first overhead vapor stream rich in alkene and alkane from the first distillation tower and passing said first overhead vapor stream to a middle distillation stage of a second distillation tower;

controlling operating pressure in the second distillation tower at predetermined pressure;

recovering a second overhead vapor stream rich in alkene from the second distillation tower;

adiabatically compressing the alkene-rich vapor stream and passing said compressed vapor to a second distillation tower reboiler stage;

cooling and condensing the compressed vapor and heating a liquid reboiler stream;

flashing cooled and condensed vapor from the reboiler stage to provide a partially vaporized flashed mixture stream rich in alkene;

recovering and separating the flashed mixture stream to provide recovering a liquid portion and vapor portion;

passing the liquid portion to a second distillation tower reflux stage at an effective reflux ratio not greater than 0.50;

withdrawing an intermediate liquid stream rich in alkene and alkane from a middle stage of the second distillation tower;

passing said intermediate liquid stream to a first distillation tower reflux stage;

recovering the heavier component from the first distillation tower;

recovering alkane from the second distillation tower reboiler stage; and recovering an alkene product stream.

* * * * *